US011207555B2

(12) United States Patent
Subbarao

(10) Patent No.: US 11,207,555 B2
(45) Date of Patent: Dec. 28, 2021

(54) FIRE EXTINGUISHING AND SUPPRESSION SYSTEM FOR VERTICAL WALLS

(71) Applicant: Leo Devaraj Subbarao, Glen Oaks, NY (US)

(72) Inventor: Leo Devaraj Subbarao, Glen Oaks, NY (US)

(73) Assignee: Leo Subbarao, Glen Oaks, NY (US)

( * ) Notice: Subject to any disclaimer, the term of this patent is extended or adjusted under 35 U.S.C. 154(b) by 179 days.

(21) Appl. No.: 16/561,737

(22) Filed: Sep. 5, 2019

(65) Prior Publication Data

US 2020/0086153 A1 Mar. 19, 2020

Related U.S. Application Data

(60) Provisional application No. 62/727,579, filed on Sep. 6, 2018.

(51) Int. Cl.

| | |
|---|---|
| ***A62C 35/00*** | (2006.01) |
| ***A62C 35/68*** | (2006.01) |
| ***G08B 17/10*** | (2006.01) |

(52) U.S. Cl.

CPC ..... *A62C 35/68* (2013.01); *G08B 17/10* (2013.01)

(58) Field of Classification Search

CPC ..... A62C 35/68; A62C 37/44; G08B 17/10; G08B 7/06

See application file for complete search history.

(56) References Cited

U.S. PATENT DOCUMENTS

| | | | | |
|---|---|---|---|---|
| 4,712,096 | A * | 12/1987 | Cholin | G02B 6/4206 340/590 |
| 2004/0026094 | A1* | 2/2004 | Kretzschmar | A62C 35/60 169/16 |
| 2009/0121045 | A1* | 5/2009 | Su | A62C 35/62 239/208 |
| 2012/0186831 | A1* | 7/2012 | Simpson | A62C 13/66 169/27 |
| 2014/0096980 | A1* | 4/2014 | Dzegan | E04C 2/525 169/16 |
| 2015/0179052 | A1* | 6/2015 | Covington | G08B 17/00 348/143 |
| 2017/0284095 | A1* | 10/2017 | Collins | E04C 2/284 |
| 2018/0078801 | A1* | 3/2018 | Perkovich | A62C 3/02 |
| 2019/0040627 | A1* | 2/2019 | Simontacchi | E04B 9/001 |
| 2019/0093356 | A1* | 3/2019 | Collins | E04C 2/521 |
| 2019/0099631 | A1* | 4/2019 | Hart | A62C 35/68 |

* cited by examiner

*Primary Examiner* — Ojiako K Nwugo
(74) *Attorney, Agent, or Firm* — David Groesbeck

(57) ABSTRACT

Systems and methods for extinguishing a fire on an exterior surface of a building are disclosed. A fire detection system identifies the presence of a fire and in response a valve is actuated to direct water through a fluid channel out of an orifice and onto an exterior surface of the building. The water is delivered such that it flows down the exterior surface without ejecting away from the building.

18 Claims, 2 Drawing Sheets

FIRE EXTINGUISHING AND SUPPRESSION SYSTEM FOR VERTICAL WALLS

CROSS-REFERENCE TO RELATED APPLICATIONS

This application claims priority to U.S. Provisional Patent Application No. 62/727,579 entitled "FIRE EXTINGUISHING AND SUPPRESSION SYSTEM FOR VERTICAL WALLS filed Sep. 6, 2018 which is incorporated herein by reference in its entirety.

BACKGROUND

Fire has always been a danger to buildings, structures, and people. There have been many developments in building materials, and some of these present a different and perhaps greater risk than conventional materials. One such advancement is building cladding. Cladding is used to alter the appearance of a building and/or insulate it, and as such is affixed to an exterior surface of the building. However, some of these materials can increase the risk presented by a fire. There is a need in the art for effective fire prevention, suppression and extinguishing methods and systems to address these problems in vertical walls.

SUMMARY

Embodiments of the present disclosure are directed to a system for extinguishing a fire. The system includes cladding configured to fasten to an exterior wall of a building with an interior side facing the exterior wall and an exterior side facing away from the wall, and a fire detector configured to identify the presence of a fire. The fire detector may be affixed to an exterior surface of the cladding. The system also includes a valve operatively coupled to the fire detector and being configured to release in response to the fire detector identifying the presence of a fire, and a fluid delivery channel fluidly coupled to the valve and being configured to conduct fluid from the valve to the exterior surface of the cladding. The fluid delivery channel and valve are configured to permit water to flow outwardly and onto the exterior surface without discharging the water away from the exterior surface.

In further embodiments the present disclosure is directed to an apparatus for extinguishing a fire on an exterior surface of a building including a valve coupled to a water supply in a building and to a fire detection system in the building, the valve being operative to release in response to a signal from the fire detection system. The apparatus also includes a pipe coupled to the valve and configured to conduct water from the valve to an exterior surface of the building. The pipe extends generally horizontally along the exterior surface of the building and has a plurality of orifices that are generally flush with the exterior surface of the building. The orifices permit water to flow outwardly when so directed by the valve. The valve and water supply may provide sufficient water pressure to allow water to flow outwardly from the pipe, but not so much pressure that water is ejected away from the exterior surface of the building.

Still further embodiments of the present disclosure are directed to a method of extinguishing a fire on an exterior surface of a building. The method includes receiving a signal that there is a fire in or around the building, and in response to the signal, directing water to flow through a water delivery channel that is positioned at an exterior surface of the building. The method also includes directing the water to flow from the fluid delivery channel onto the exterior surface of the building with sufficient pressure to flow outwardly without directing the water to project outwardly from the exterior surface of the building.

DETAILED DESCRIPTION

Figure 1:
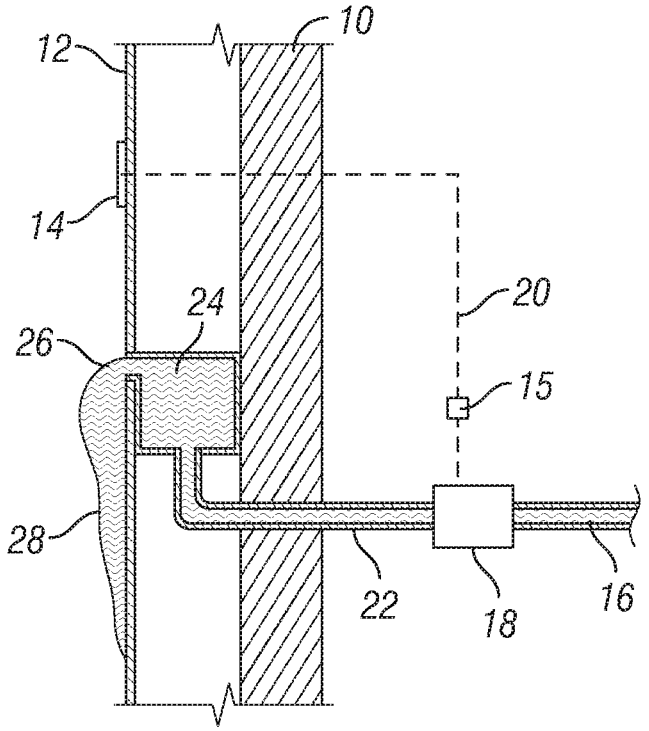
FIG. 1 is a cross-sectional schematic view of a wall of a building according to embodiments of the present disclosure.

Below is a detailed description according to various embodiments of the present disclosure. A suppression system for use with buildings and other structures is disclosed. FIG. 1 is a cross-sectional schematic view of a wall 10 of a building according to embodiments of the present disclosure. The wall 10 is a vertical wall and can be an exterior wall or an interior wall. The wall is vertical, but the systems and methods of the present disclosure can be used with walls having a different orientation. The wall 10 has cladding 12 affixed to the wall 10. In some embodiments the cladding is attached directly to the wall 10 with the cladding 12 contacting the wall 10. In other embodiments the cladding 12 is spaced apart from the wall 10 by a certain distance. The cladding 12 can be thicker than the wall 10, or vice versa. Cladding 12 can be installed in sections covering substantially all of the exposed wall 10 or it can cover only a portion of the wall 10.

The system includes a fire detector 14 (heat, smoke, radiant sensing, etc.) coupled to the cladding 12. The fire detector 14 can be any conventional temperature-sensitive device configured to monitor a fire. The fire detector 14 can be coupled electronically to a control unit 15 via an electrical connection 20. In some embodiments the fire detector 14 can be wirelessly connected to the controller 15. In still further embodiments the heat detector is coupled to a remote system. The fire detector 14 has a threshold above which it will issue an alarm that there is a fire. The alarm can be issued to the controller 15 or to a remote device. In some embodiments the fire detector 14 is equipped with an onboard alarm in which case there may or may not be a connection to a controller or another remote system.

The system also includes a water source 16 which can be any piping or other supply of water as is common in nearly every building in existence. The system can include a valve 18 coupled to the water source 16 which is also coupled to the controller 15 and is configured to open in response to a signal such as if the fire detector 14 determines that there is a fire. The system can also include a water conduit 22 that leads to a spillway 24. The spillway 24 has an outlet 26 that is positioned in the cladding 12 with the outlet 26 positioned to permit water to flow from the outlet 26 and down the side of the cladding 12. The spillway 24 can contain some or no water while there is no alarm present, and the alarm can cause the valve 18 to increase the water level in the spillway 24 such that water spills outward and onto the cladding 12. In some embodiments the outlet 26 is positioned at or very nearly at the exterior surface of the cladding 12 such that water will flow downward onto the cladding 12 without flowing forward and away from the cladding 12.

In some embodiments the outlet 26 extends widely in a direction transverse to the viewing plane such that the water is delivered to a wide section of the cladding 12 using a relatively small number of spillways 24. Of course there can be as many spillways 24 and/or valves as needed to service a section of cladding 12, but the wide outlet 26 allows for a wide section of the cladding 12 to be covered in the event of a fire.

The configuration of the present disclosure as shown in FIG. 1 allows for a highly efficient fire extinguishing and suppression system. Existing fire suppression systems are horizontal—that is, they are designed to discharge water in a horizontal direction outwardly from the wall. Most if not all the water is projected away from the wall and is not effective for suppressing the fire on the wall. The system of the present disclosure is different. It directs the water onto the wall in a vertical direction to promote more thorough covering of the wall resulting in a more efficient and effective fire suppression system. The reservoir 24 and valve 18 can be configured such that the flow out of the outlet 26 is slow and perhaps laminar such that there is little or no separation from the cladding 12. In some embodiments the outlet 26 is recessed into the cladding 12 so that the water flows on an exposed vertical surface for a short distance before reaching the end and moving downward. The adhesive properties of water will cause the water to move along the surface and not to spray outwardly and away from the cladding 12.

In some embodiments there can be multiple outlets from the reservoir 24. For instance, if the cladding 12 were to be spaced apart from the wall 10, there can be an outlet leading to the space between the cladding 12 and the wall 10. Dispensing water into this space can be an effective fire extinguishing, suppression, or prevention means. In some embodiments there can be multiple outlets which are operated differently based at least in part upon a response from the fire detector 14. In some embodiments there can be a second heat detector (not shown) in the interior space between the cladding 12 and the wall 10 and when this heat detector alarms, the system can be instructed to deliver water there. In other embodiments all outlets 26 fire together in response to any single (or subset) of heat detectors issuing alarms.

Figure 2:
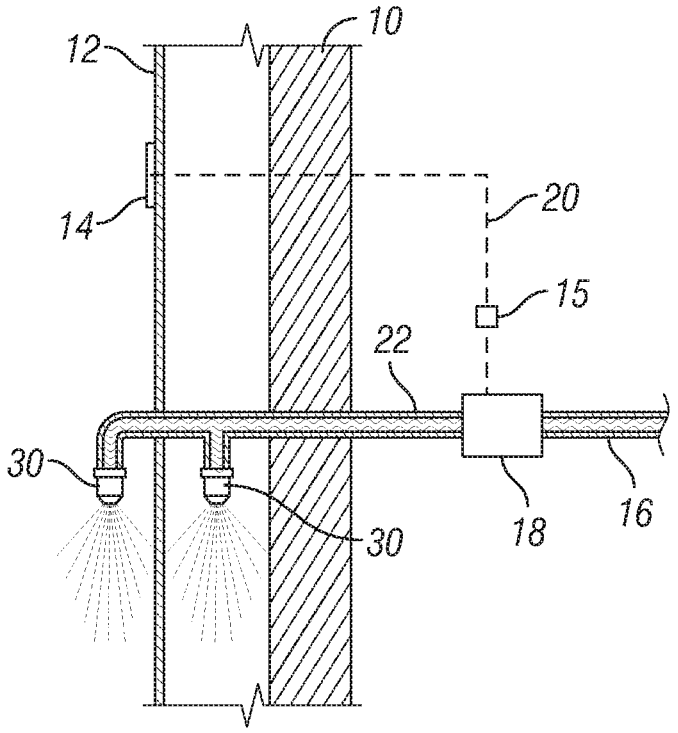
FIG. 2 is a cross-sectional schematic view of another embodiment of the present disclosure.

FIG. 2 is a cross-sectional schematic view of another embodiment of the present disclosure. Many features are similar to analogous features in FIG. 1. The reservoir is replaced by nozzles 30. There is a space between the wall 10 and the cladding 12 and there are nozzles positioned in the space. In some embodiments the nozzles can be directed to dispense water toward the cladding 12 in the case of the exterior-nozzle and in both directions in the case of the interior nozzle.

Unlike previous systems inside buildings, where a water spray is discharged, the water discharge forms a sheet of water on the exterior of the building that is used to extinguish/suppress/control the fire.

Figure 3:
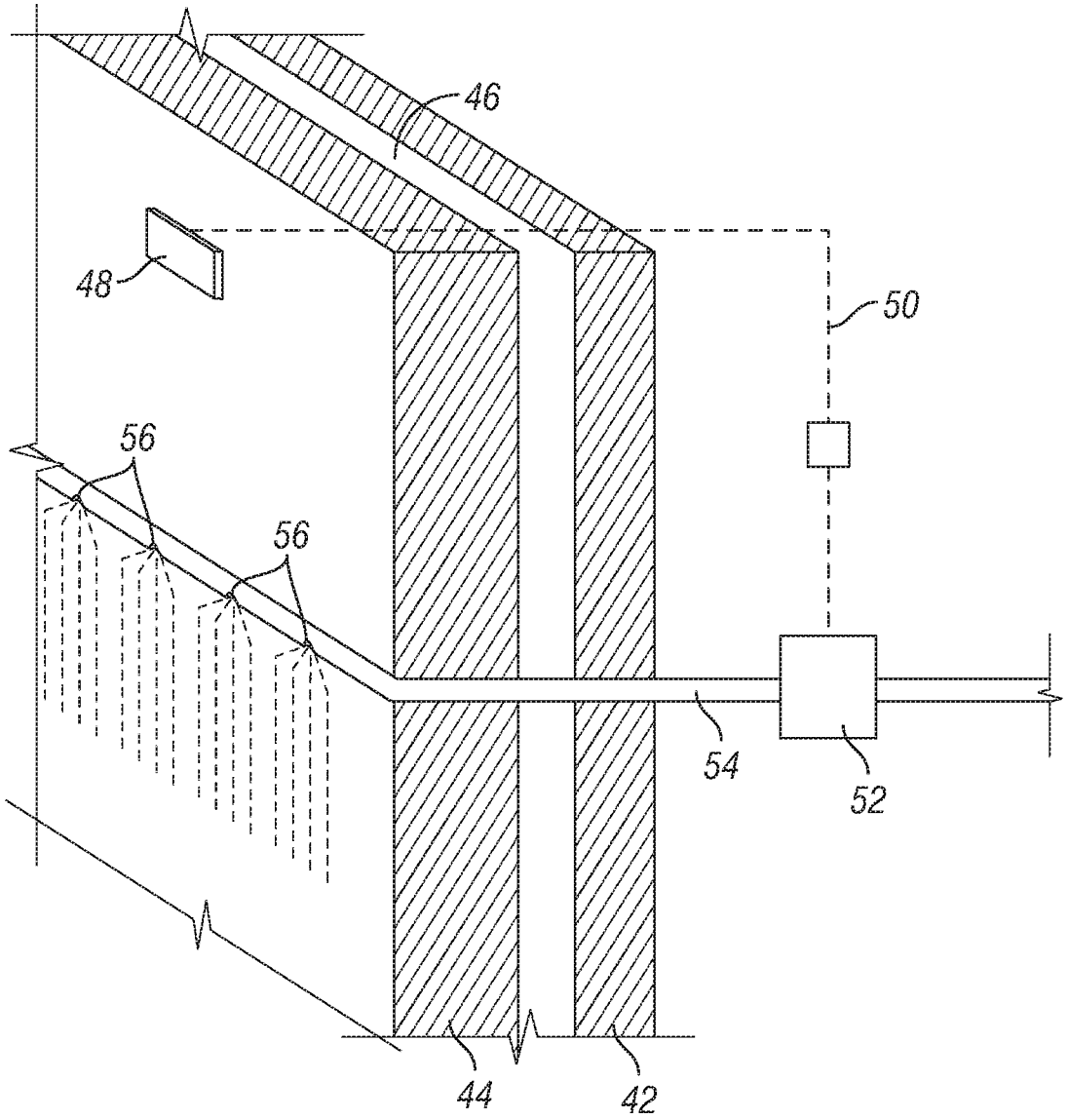
FIG. 3 is another cross-sectional view of a fire extinguishing system according to further embodiments of the present disclosure.

FIG. 3 is another cross-sectional view of a fire extinguishing system 40 according to further embodiments of the present disclosure. The system 40 can be installed in a building having exterior walls 42. The system 40 can include cladding 44 which can be fastened to the wall 42 and can be coextensive with the exterior wall 42 or it can cover sections of the wall leaving some sections uncovered by the cladding. The cladding 44 can be offset from the wall by a space 46 that can be approximately one inch from the wall 42. The space 46 can be left empty and therefore filled with ambient air. In some embodiments the space 46 can be filled with a fluid or a solid such as a foam spray having flame retardant properties. In some embodiments the cladding 44 can be secured directly to the exterior walls 42 with no space therebetween.

The system 40 includes a fire detector 48 that can be a heat detector, a smoke detector, a chemical detector, or any other suitable fire detecting apparatus. The fire detector 48 can be secured to the cladding 44 and can be sensitive to locations on an exterior surface of the cladding, an interior surface of the cladding, or a combination of both. There may also be fire detectors in the space 46 and on the exterior wall 42. The fire detector 48 is operably coupled via an electrical connection 50 which can be a wired or a wireless connection to an automatic valve 52. The valve 52 is connected to a water supply in the building. In some embodiments the water supply is the main water supply for the building. In other embodiments there is a separate water supply dedicated to the fire suppression system 40. The supply may be another fluid than water that is used to extinguish fires. In response to detecting a fire the valve 52 is opened and pressure in the water supply directs the water through the valve 52.

The valve 52 is connected to a pipe 54 that extends through the wall 42 and through the cladding 44 and also extends along an exterior surface of the cladding 44. The pipe 54 has holes 56 at various positions along the pipe 54 that are directed outward from the cladding 44 in such a manner to allow water to flow out of the holes 56 and onto the cladding 44. The holes 56 can include nozzles (not shown) that are secured to the pipe 54 to further enable water delivery. The holes 56 are configured to direct water to flow from the pipe 54 onto an exterior surface of the cladding to extinguish a fire that has reached the cladding on an exterior surface. The pipe 54 may have additional holes that face into the space and there may be additional holes and piping that delivers water onto the surfaces of the building as needed. In some embodiments there is a diverter valve that is configured to direct water to various locations in the building, including diverting between exterior cladding, space between cladding and wall, exterior wall, and interior wall as needed.

In some embodiments the holes are slits that are spaced apart from one another sufficiently to allow a predetermined quantity of water to flow outward onto the building. In some embodiments the holes are evenly spaced apart along the length of the pipe that is exposed through the cladding. The embodiments of the present disclosure enable a simple, cost-effective way to deliver water to an exterior surface of a building that is superior in effectiveness and convenience when compared to previous designs.

The invention claimed is:

1. A system for extinguishing a fire, the system comprising:

cladding configured to fasten to an exterior wall of a building with an interior side facing the exterior wall and an exterior side facing away from the wall;

a fire detector configured to identify the presence of a fire, the fire detector being affixed to an exterior surface of the cladding;

a valve operatively coupled to the fire detector and being configured to release in response to the fire detector identifying the presence of a fire; and a fluid delivery channel fluidly coupled to the valve and being configured to conduct fluid from the valve to the exterior surface of the cladding.

2. The system of claim 1 wherein the cladding is fastened directly to the wall with the cladding contacting the wall.

3. The system of claim 1 wherein the cladding is spaced apart from the wall.

4. The system of claim 3 wherein the fluid delivery channel comprises a first orifice positioned at the exterior side of the cladding and a second orifice positioned between the cladding and the wall.

5. The system of claim 1 wherein the fluid delivery channel comprises a reservoir within the cladding and wherein the reservoir is configured to overflow when the valve releases, such that water flows over an edge of the reservoir onto the exterior side of the cladding.

6. The system of claim 1 wherein the fluid deliver channel comprises a pipe has a first section that extends through the cladding to the exterior side of the cladding and a second section that is exposed on the exterior side of the cladding.

7. The system of claim 6 wherein the second section includes a plurality of holes configured to permit water to flow outward onto the exterior side of the cladding.

8. The system of claim 6 wherein the pipe extends generally horizontally along the exterior side of the cladding.

9. The system of claim 8 wherein an exterior surface of the pipe is substantially flush with the exterior side of the cladding.

10. The system of claim 1 wherein the fluid delivery channel and valve are configured to permit water to flow outwardly and onto the exterior surface without discharging the water away from the exterior surface.

11. An apparatus for extinguishing a fire on an exterior surface of a building, the apparatus comprising:

a valve coupled to a water supply in a building and to a fire detection system in the building, the valve being operative to release in response to a signal from the fire detection system; and a pipe coupled to the valve and configured to conduct water from the valve to an exterior surface of the building, the pipe extending generally horizontally along the exterior surface of the building, the pipe having a plurality of orifices that are generally flush with the exterior surface of the building, the orifices being configured to permit water to flow outwardly when so directed by the valve.

12. The apparatus of claim 11 wherein the exterior surface of the building comprises a cladding.

13. The apparatus of claim 12 wherein the cladding is spaced apart from the building.

14. The apparatus of claim 11, further comprising nozzles on the orifices to enable water deliver to the exterior surface of the building.

15. The apparatus of claim 11 wherein the valve and water supply are configured to provide sufficient water pressure to allow water to flow outwardly from the pipe, but not so much pressure that water is ejected away from the exterior surface of the building.

16. A method of extinguishing a fire on an exterior surface of a building, the method comprising:

receiving a signal that there is a fire in or around the building;

in response to the signal, directing water to flow through a water delivery channel that is positioned at an exterior surface of the building; and directing the water to flow from the fluid delivery channel onto the exterior surface of the building with sufficient pressure to flow outwardly without directing the water to project outwardly from the exterior surface of the building.

17. The method of claim 16 wherein the fluid delivery channel comprises a pipe extending generally horizontally along the exterior surface of the building, the pipe having a plurality of orifices spaced along a length of the pipe.

18. The method of claim 16 wherein the exterior surface of the building comprises a cladding fastened to the building.

* * * * *